US006026169A

United States Patent [19]

Fujimori

[11] Patent Number: 6,026,169

[45] Date of Patent: Feb. 15, 2000

[54] SOUND IMAGE LOCALIZATION DEVICE

[75] Inventor: Junichi Fujimori, Hamamatsu, Japan

[73] Assignee: Yamaha Corporation, Hamamatsu, Japan

[21] Appl. No.: 08/652,911

[22] Filed: May 23, 1996

Related U.S. Application Data

[63] Continuation of application No. 08/549,082, Oct. 27, 1995, abandoned, which is a continuation of application No. 08/097,196, Jul. 26, 1993, abandoned.

[30] Foreign Application Priority Data

Jul. 27, 1992 [JP] Japan ..... 4-219752
Apr. 6, 1993 [JP] Japan ..... 5-103511

[51] Int. Cl.[7] ..... H03G 3/00

[52] U.S. Cl. ..... 381/61; 381/17

[58] Field of Search ..... 381/17, 18–61, 381/63

[56] References Cited

U.S. PATENT DOCUMENTS 4,118,599 10/1978 Iwahara et al. .
4,188,504 2/1980 Kasuga et al. .
4,219,696 8/1980 Kogure et al. .
4,817,149 3/1989 Myers .
4,908,858 3/1990 Ohno ..... 381/17
5,046,097 9/1991 Lowe et al. .
5,105,462 4/1992 Lowe et al. .
5,386,082 1/1995 Higashi ..... 381/17
5,500,900 3/1996 Chen et al. ..... 381/17

FOREIGN PATENT DOCUMENTS 355835 8/1991 Japan .

*Primary Examiner*—Ping W Lee
*Attorney, Agent, or Firm*—Pillsbury Madison & Sutro LLP

[57] ABSTRACT

A sound image localization device includes a delay circuit and a multiplier which cooperate to cause a time difference and an amplitude difference between left and right channel audio signals. One of the channel audio signals is inverted in phase. The channel audio signals thus having a time difference and an amplitude difference, with one of them being inverted in phase, are amplified by an amplifier and outputted through left and right loudspeakers as sound, whereby a sound image formed by the audio signals can be localized at a rearward position with respect to the listener.

36 Claims, 8 Drawing Sheets

SOUND SOURCE
A
ASL
ASR
-1
7
SWITCH
8
F/B
DELAY CIRCUIT
1
DELAY CIRCUIT
2
Tl
Tr
3
4
Cl
Cr
HEAD-PHONE AMPLIFIER
5
6
CONTROL PARAMETER GENERATOR
10
θ
D
IMAGE OPERATION LOCATION UNIT
9
DIRECTION CONTROL DIAL
9a
DISTANCE CONTROL SLIDER
9b

SOUND IMAGE LOCALIZATION DEVICE

This is a continuation of application Ser. No. 08/549,082, filed Oct. 27, 1995, now abandoned, which is a continuation of application Ser. No. 08/097,196, filed Jul. 26, 1993, now abandoned.

BACKGROUND OF THE INVENTION

1. Field of the Invention

This invention relates to a sound image localization device which processes an audio signal such that a sound image formed by the audio signal is localized at a location rearward of the listener.

2. Prior Art

Conventionally, there has been proposed a sound image localization device which operates to delay timing of the transmission of at least one of the audio signals of the left and right channels as well as adjusting the amplitude thereof to cause a time difference and an amplitude difference between the left and right channel signals so as to impart a feeling of orientation and a feeling of space to the reproduced sound, to thereby control the localization of a sound image formed by the audio signals to any desired location.

An example of such a sound image localization device is shown in FIG. 1, which includes a pair of delay circuits 1 and 2 which delay the audio signals of respective left and right channels so as to cause a time difference between the two channel signals, multipliers 3 and 4 which adjust the amplitude of the respective channel signals so as to cause an amplitude difference therebetween, a head-phone amplifier 5, and a head-phone 6. Of the left and right channel audio signals, the left audio channel signal is delayed by the delay circuit 1 and the delayed signal is controlled in amplitude by the multiplier 3, to be supplied to a left channel input of the head-phone amplifier 5. Similarly, the right channel audio signal is delayed by the delay circuit 2 and the delayed signal is controlled in amplitude by the multiplier 4, to be supplied to a right channel input of the headphone amplifier 5. Then, the left and right channel signals are amplified by the head-phone amplifier 5 and then outputted in the form of sound through left and right loudspeakers of the head-phone 6.

FIG. 2 schematically shows coordinates representing the positional relationship between a sound source and a listener, which is useful in explaining the principle of operation of the sound image localization device of FIG. 1. The coordinates can also apply in explaining embodiments of the present invention, hereinafter described. In FIG. 2, the listener is positioned at a center 0 of the X-Y coordinates. The distance between the listener's ears is 15 cm, for instance. The location of the sound source is determined by an angle θ of the sound source taken clockwise relative to the X-axis and the distance D between the sound source and the center 0. For example, if the sound source is located at a point S in the figure, the location of the point S can be represented by the angle θ and the distance $D_1$.

If an actual sound source and a listener are placed in a listening situation defined by the coordinates explained above, when the listener hears sound generated from the sound source located at the point S, the feeling of orientation and the feeling of space which the sound source gives to the listener are determined by a difference between time periods elapsed from generation of the sound to the time the sound reaches the listener's left and right ears, and a difference in amplitude (sound intensity) between sound reaching the left ear and one reaching the right ear, i.e. a difference in amount of attenuation of the amplitude therebetween which is caused by a difference in distance between the left and right ears.

In the arrangement of FIG. 1, if it is desired to localize the image at the point S which is in a left forward position with respect to the listener during playback of sound, the amount of delay by the delay circuit 2 of the right channel is set larger by a given time period corresponding to the position S than that by the delay circuit 3 of the left channel, and further an amplitude adjusting input value to the right channel multiplier 4 is set smaller by a given value corresponding to the position S than that to the left channel multiplier 3. Then, the listener feels that the image is located at the point S, during playback.

However, in the conventional sound image localization device which controls only the time difference and the amplitude difference, if it is desired to localize the image at a position S' which is symmetrical with the position S with respect to the listener in FIG. 2, the time difference and the amplitude difference are set to the same values as those set when the image is localized at the position S. As a result, the listener cannot discriminate whether the sound comes from a forward position (position S) or from a rearward position (position S').

SUMMARY OF THE INVENTION

It is a first object of the invention to provide a sound image localization device which is capable of positively making clear a difference in the feeling of localization between when the image-localized position is set to a forward position and when it is set to a rearward position.

It is a second object of the invention to provide a sound image localization device which is capable of smoothly moving the image-localized position from a forward position to a rearward position and vice versa, without occurrence of a discontinuity noise.

To attain the first object, the present invention provides a sound image localization device including a sound source, first channel signal generation means for generating a first channel signal on a basis of the sound source, second channel signal generation means for generating a second channel signal on a basis of the sound source, the first and second channel signal generation means causing a time difference and an amplitude difference between the first and second channel signals, and phase-inverting means for inverting a phase of the second channel signal.

Preferably, the phase-inverting means includes a invertor.

Alternatively, the phase-inverting means includes a phase interpolation filter.

Also preferably, the sound image localization device further includes second phase inverting-means for inverting a phase of the first channel signal.

Preferably, the second phase-inverting means includes a invertor.

Alternatively, the second phase-inverting means includes a phase interpolation filter.

In a preferred form, the sound image localization device further includes sound image location setting means for setting a sound image localization position of a sound signal from the sound source and outputting a control signal corresponding to a sound image localization position set by the sound image location setting means, wherein the first and second channel signal generation means are responsive to the control signal to cause the time difference and the amplitude difference between the first and second channel signals to vary in accordance with the control signal.

Preferably, the first and second channel generation device including a delay device and a multiplier.

In another preferred form, the sound image localization device receives a sound signal from a sound source, and includes a first channel signal generation device for generating a first channel signal on a basis of the sound signal of the sound source, a second channel signal generation device for generating a second channel signal on a basis of the sound signal of the sound source, the first and second channel signal generation devices causing a time difference and an amplitude difference between the first and second channel signals, and a phase-inverting device for inverting a phase of the second channel signal.

To attain the second object, the present invention provides a sound image localization device connecting a sound source, including sound image location setting means for setting on a real time basis a sound image localization position of a sound signal from the sound source, first and second channel signal generation means for generating first and second channel signals on a basis of the sound source, the first and second channel signal generation means causing a time difference and an amplitude difference between the first and second channel signals in accordance with a sound image localization position set by the sound image localization setting means, phase shifting means for shifting a phase of the second channel signals in accordance with a sound image localization position set by the sound image location setting means.

Further preferably, the sound image localization device further includes a pair of loudspeakers for respectively generating the first and second channel signals, and a cross-talk canceling device provided between the first and second channel signal generating means and the pair of loudspeakers for canceling cross-talk between the pair of loudspeakers and a listener.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 3:
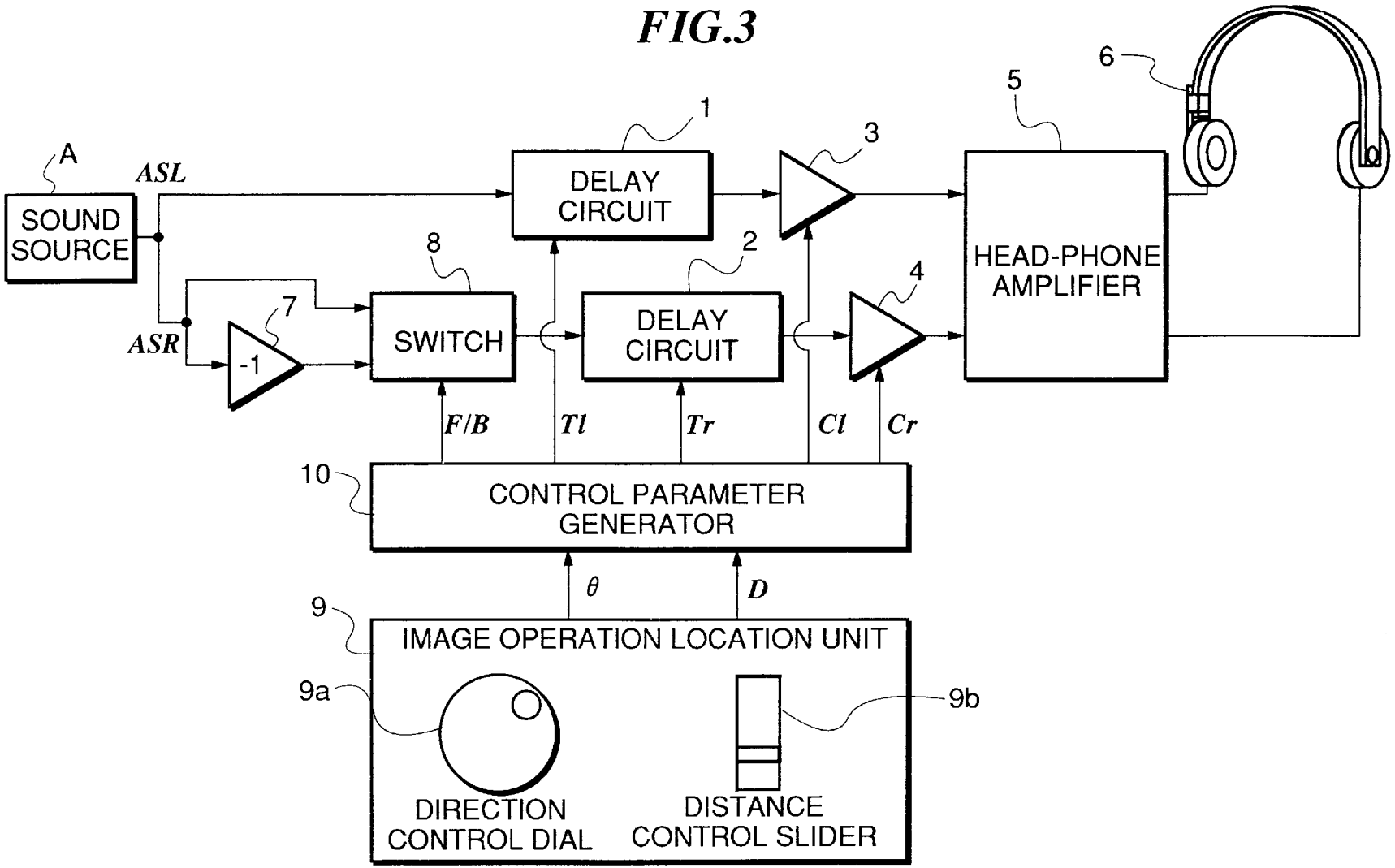
FIG. 3 is a schematic block diagram showing the arrangement of a sound image localization device according to a first embodiment of the present invention.

Referring first to FIG. 3, there is illustrated the arrangement of a sound image localization device according to a first embodiment of the invention.

Figure 1:
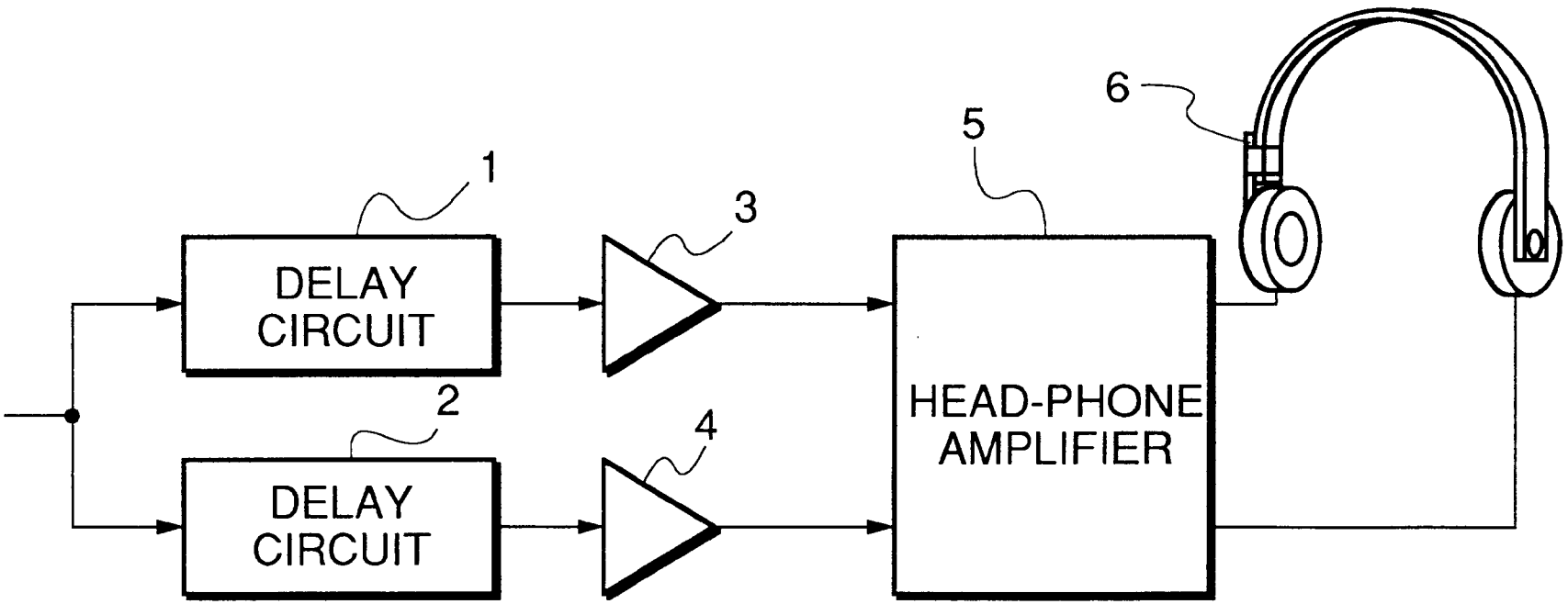
FIG.1 PRIOR ART
FIG. 1 is a schematic block diagram showing the arrangement of a conventional sound image localization device.

As shown in the figure, the sound image localization device according to the first embodiment includes of delay circuits 1 and 2, multipliers 3 and 4, a head-phone amplifier 5, and a head-phone 6, the elements 1 to 6 being substantially identical in arrangement and function with corresponding elements in the prior art of FIG. 1, an invertor 7 forming an essential feature of the invention, and a two-input switch 8. The invertor 7 and the two-input switch 8 are arranged at an input side of the right channel delay circuit 2 in the illustrated embodiment. More specifically, an output of the invertor 7 is connected to one input terminal of the switch 8 to supply the latter with an audio signal, hereinafter referred to.

A digital audio signal from a monoral-channel audio device A as a sound source, e.g., an electronic musical instrument is supplied as a left channel audio signal (hereinafter referred to as "the signal ASL") and a right channel audio signal (hereinafter referred to as "the signal ASR") to respective left and right channel systems. The signal ASL is supplied to the delay circuit 1, while the signal ASR is further supplied to two signal lines, one of which is directly connected to the other input terminal of the switch 8, and the other signal line is connected to the above one input terminal of the switch 8 via the invertor 7.

The delay circuit 1 is further supplied with a signal Tl for controlling a delay time of the signal ASL, and has an output thereof connected to an input of the multiplier 3. The multiplier 3 is supplied with a signal Cl for controlling the amplitude of an input signal thereto to output a signal having been controlled in amplitude. An output of the multiplier 3 is connected to an input terminal of the head-phone amplifier 5 via a D/A converter, not shown.

The switch 8 is also supplied with a changeover signal F/B for commanding changeover of its two inputs, and has an input thereof connected to an input of the delay circuit 2. The delay circuit 2 is supplied with a signal Tr similar to the signal Tl mentioned above, for controlling a delay time of an input signal thereto. An output of the delay circuit 2 is connected to an input of the multiplier 4 which is supplied with an amplitude control signal Cr similar to the signal Cl to the multiplier 3. An output signal from the multiplier 4, which has been controlled in amplitude by the signal Cr, is supplied to the other input terminal of the head-phone amplifier 5 via a D/A converter, not shown. Left and right channel output signals from the head-phone amplifier 5 are supplied to left and right loudspeakers of the head-phone 6 to be outputted as sound.

The sound image localization device further has an image location operating unit 9 having a direction control dial 9*a* and a distance control slider 9*b*, and a control parameter generator 10. The control parameter generator 10 generates the above-mentioned control signals Tl, Tr, Cl, Cr, and F/B in response to operation of the operating unit 9. More specifically, the operating unit 9 is connected to the control parameter generator 10 to supply the same with an angle signal θ and a distance control signal D. The angle signal θ is set to vary by rotating the direction control dial 9*a,* and the distance signal D by vertically or horizontally moving the distance control slider 9*b.* The control parameter generator 10, which is formed of a microprocessor, etc., calculates the values of the signals Tl, Tr, Cl, Cr, and F/B according to the relationship shown in FIG. 2, referred to hereinbefore, and outputs the calculated signals.

The operation of the sound image localization device constructed as above will now be described, on the assumption that it is connected to an electronic musical instrument.

First, the listener with the head-phone 6 on depresses a keyboard of the electronic musical instrument, not shown, to generate a musical tone. Then, when the listener desires to listen to musical tones assuming that the sound source (imaginary sound source) is located at the point S in FIG. 2, he rotates the direction control dial 9*a* until the direction of the point S is determined through hearing, and further vertically moves the distance control slider 9*b* until the distance from the point S is determined through hearing, while continuing to cause generation of musical tones from the musical instrument. In other words, the angle signal θ is varied through the rotation of the direction control dial 9*a,* and the distance signal D through the vertical movement of the distance control slider 9*b.* Responsive to the varied angle signal θ and distance signal D, the control parameter generator 10 calculates the signals Tl, Tr, Cl, Cr and changes the level of the signal F/B to a high (Hi) or low (Lo) level. Since the point S is located left forwardly of the listener, the signal F/B is controlled to select the signal ASR which does not pass the invertor 7, from the two signals applied to the switch 8.

Figure 2:
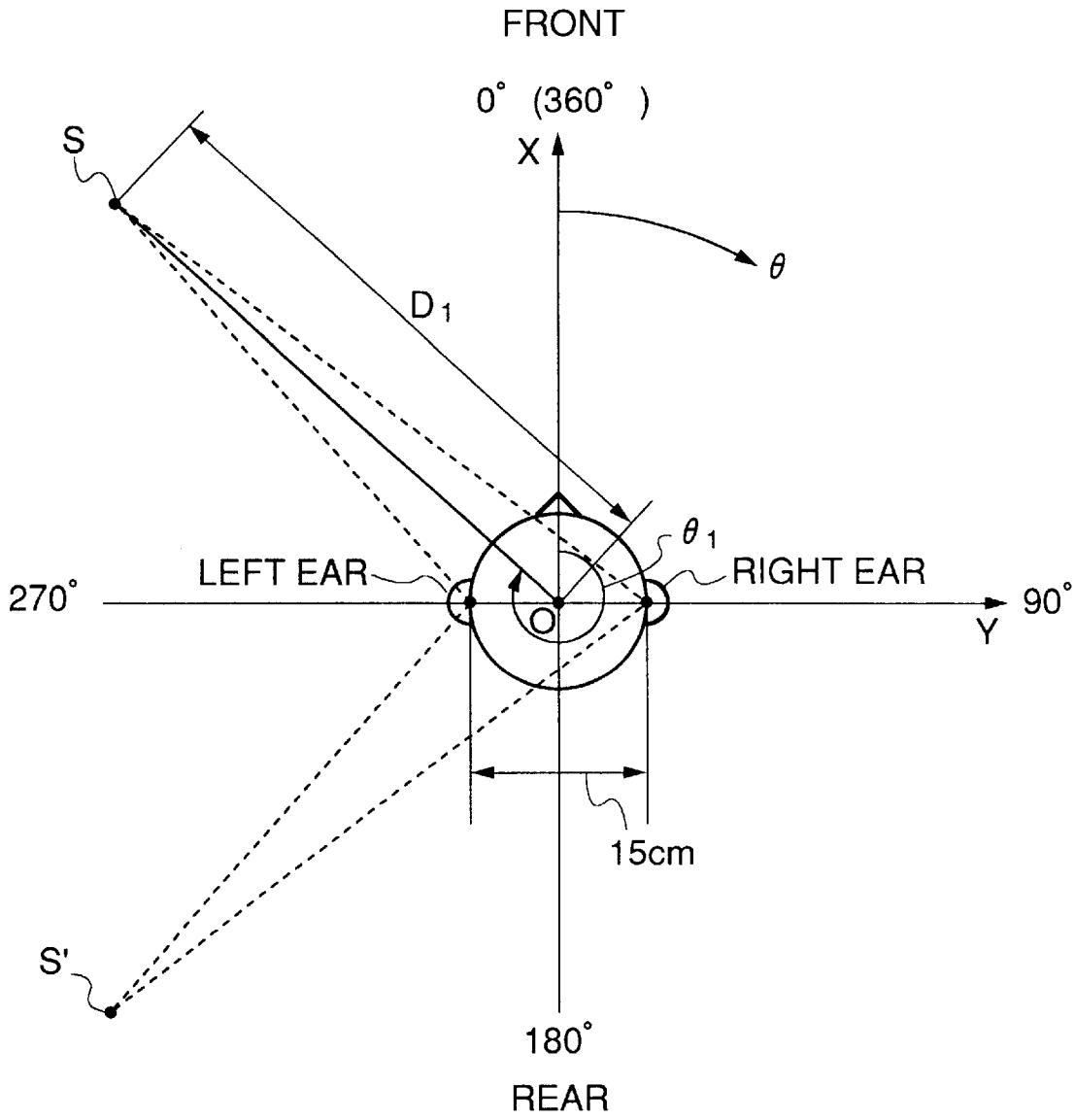
FIG. 2 is a schematic view showing coordinates defining the positional relationship between a sound source and a listener.

While the image is thus localized at the point S, if the listener desires to listen to musical tones assuming that the sound source is located at the point S' in FIG. 2, he rotates the direction control dial 9*a* without operating the distance control slider 9*b,* to determine the direction of the point S' through hearing. Then, the control parameter generator 10 calculates the signals Tl, Tr, Cl, Cr to varying values in response to the angle signal θ which successively varies with rotation of the direction control dial 9*a.* When the signal θ enters an angle range corresponding to a rearward region after passing an angle of 90° or 270°, the control parameter generator 10 inverts the level of the signal F/B so that a signal inverted from the signal ASR by the invertor 7 is outputted from the switch 8 and applied to the delay circuit 2. Thereafter, when the angle signal θ reaches the point S' in FIG. 2, which is symmetrical with the forward position S with respect to the listener, the signals Tl, Tr, Cl, Cr continue to have the same values as assumed when the point S is set as the image-localized position, except the signal F/B which then assumes a different binary level from the level at the point S.

It has been experimentally found by the present inventor that if one of left and right channel audio signals is inverted in phase when the sound image is localized at a forward position, the listener feels that the image is generated from a rearward position. The present invention is based upon this finding.

According to the first embodiment described above, it is possible to clearly discriminate between an image-localized position forward of the listener and one rearward of the listener.

In the first embodiment, however, the changeover signal F/B is merely changed in level between two levels, i.e. Hi level and Lo level. As a result, immediately upon changeover of input to the switch 8, the output from the switch 8 suddenly changes in phase to cause generation of a so-called discontinuity noise.

In the first embodiment, alternatively of the invertor 7, a multiplier may be employed to invert the phase of one of the left and right channel signals.

A second embodiment of the invention, hereinbelow described, has overcome this disadvantage.

Figure 4:
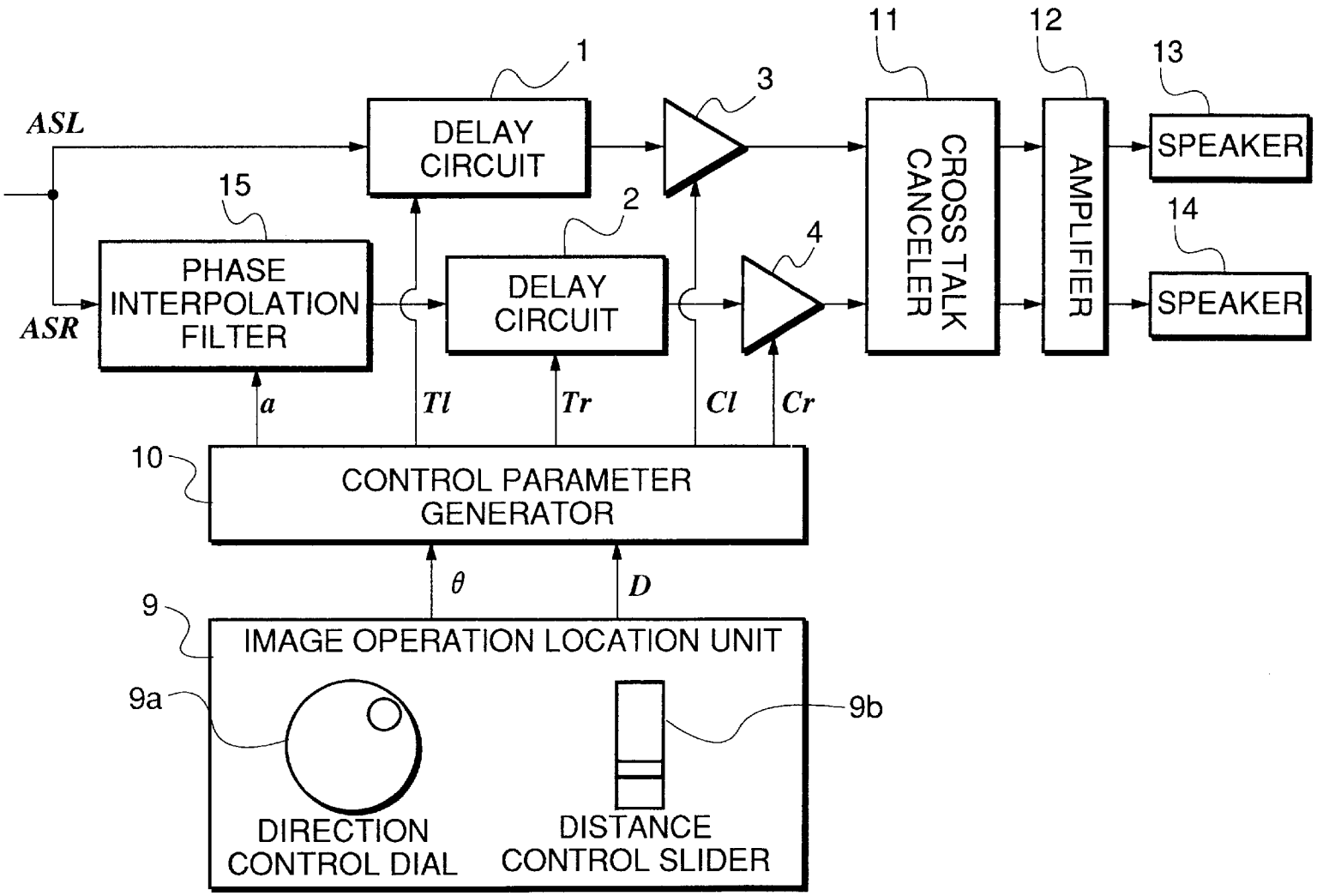
FIG. 4 is a schematic block diagram showing the arrangement of a second embodiment of the invention.

FIG. 4 shows the arrangement of the second embodiment. This embodiment is distinguished from the first embodiment described above only in that a phase interpolating filter is employed as a phase inverting circuit in place of the invertor 7, and the head-phone 6 is replaced by loudspeakers. Therefore, corresponding elements and parts to those in FIG. 3 are designated by identical reference numerals, and detailed description thereof is omitted.

As shown in FIG. 4, the sound image localization device according to this embodiment includes delay circuits 1 and 2, multipliers 3 and 4, an image location operating unit 9, and a control parameter generator 10, the elements 1–4, 9 and 10 being substantially identical in arrangement and function with corresponding elements in the first embodiment of FIG. 3. The device further includes a crosstalk canceler 11 connected to outputs of the multipliers 3, 4, an amplifier 12 connected to an output of the crosstalk canceler 11, left and right loudspeakers 13 and 14 connected to an output of the amplifier 12, and a phase interpolation filter 15 for varying the phase of an input signal thereto. The phase interpolating filter 15 is connected to an input of the right channel delay circuit 2.

A digital audio signal from an electronic musical instrument, not shown, is supplied as the signal ASL and the signal ASR, to the delay circuit 1 and the phase interpolating filter 15, respectively. An output from the delay circuit 1 is applied via the multiplier 3 to an input terminal of the crosstalk canceler 11. The crosstalk canceler 11 is adapted to apply inverse cross talk correction to left and right channel signals inputted thereto so as to cancel cross talk therebetween which would otherwise occur. The inverse cross talk correction characteristic is previously determined by the positional relationship between the loudspeakers and the listener such that an image radiated by the loudspeakers can be localized at any position not only between the left and right loudspeakers but also over the whole circumference about the listener, similarly to the case of listening with a head-phone. On the other hand, the phase interpolating filter 15 is supplied with a signal a for controlling a filter coefficient thereof, i.e. a phase shift amount thereof, and applies an output to the other input terminal of the crosstalk canceler 11 via the delay circuit 2 and the multiplier 4. Left and right channel outputs from the crosstalk canceler 11 are applied, respectively, to left and right channel input terminals of the amplifier 12 after being converted into analog signals by respective D/A converters, not shown. Left and right channel outputs from the amplifier 12 are applied, respectively, to the left and right loudspeakers 13, 14 to be radiated as sound.

Figure 5:
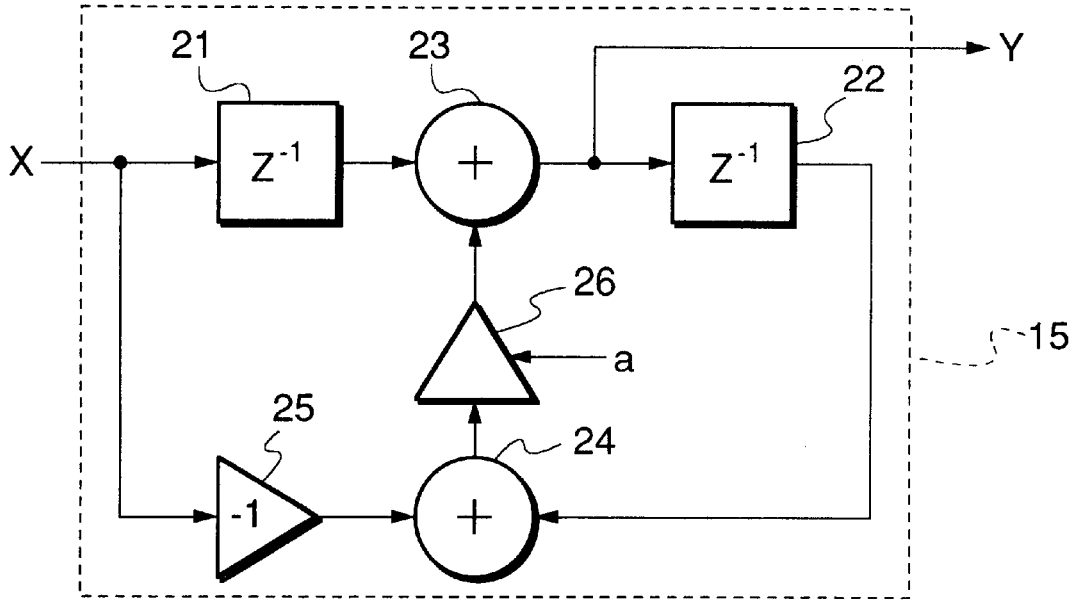
FIG. 5 is a schematic block diagram showing the arrangement of a phase interpolating filter forming an essential part of the embodiment of FIG. 4.

FIG. 5 shows the construction of the phase interpolating filter 15.

The filter 15 is formed by two delay elements 21 and 22, two adders 23 and 24, an invertor 25, and a multiplier 26. The control signal a is applied to the multiplier 26. Provided that a signal (signal ASR) inputted to an input of the phase interpolating filter 15 is designated by X, and a signal outputted therefrom is designated by Y, the filter 15 has a transfer function H(z) calculated as follows:

$$H(z)=Y/X=-(a-z^{-1})/(1-a*z^{-1}) \quad (1)$$

It is known that the formula (1) can be solved with respect to amplitude into a constant. This means that the filter has constant response in amplitude irrespective of the frequency. It is also known that if the formula (1) is solved with respect to the phase, the solution shows that the phase delay angle varies with the filter coefficient value and the frequency. Therefore, the phase interpolating filter 15 acts to shift the phase of its input signal while passing all frequency band components thereof and is thus known as a phase shifter or an all-pass filter.

The phase shifting characteristic of the phase interpolating filter 15 will now be explained with reference to FIGS. 6A, 6B, and 6C.

Figure 6A:
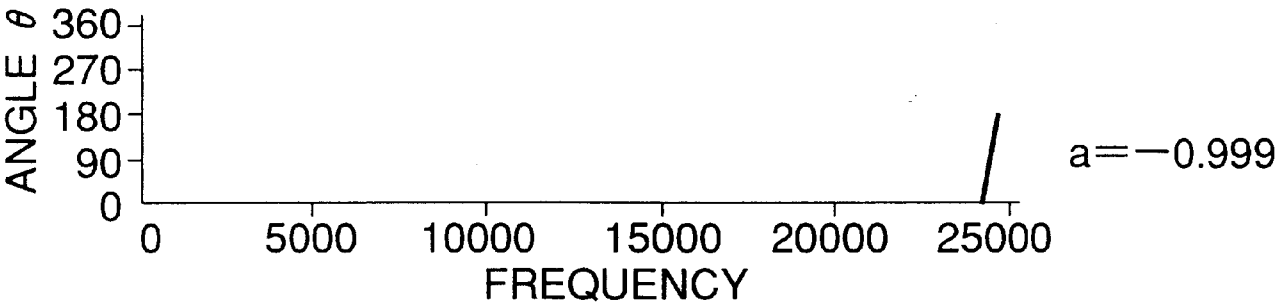
FIG. 6A is a diagram showing a phase shift amount vs. frequency characteristic of the phase interpolating filter in FIG. 5, which is obtained when a signal a=−0.999.
Figure 6B:
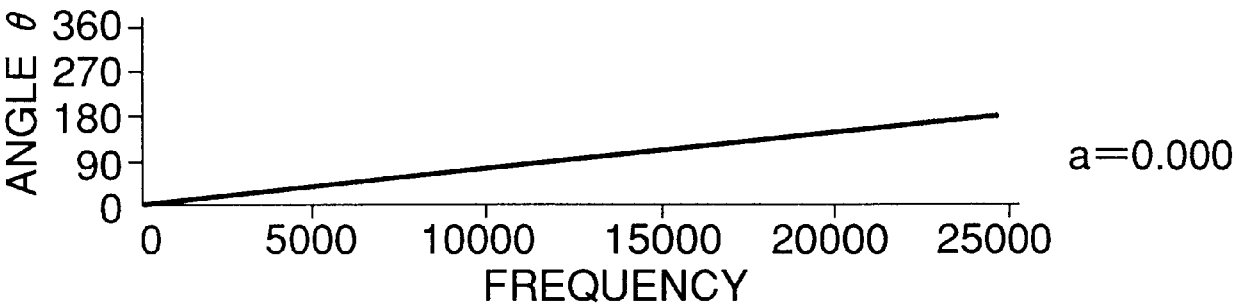
FIG. 6B is a similar view to FIG. 6A, showing the characteristic obtained when the signal a=0.000.
Figure 6C:
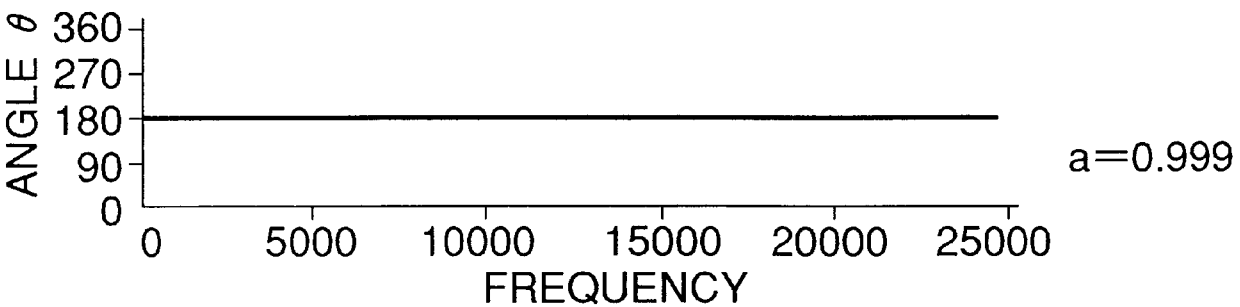
FIG. 6C is a similar view to FIG. 6A, showing the characteristic obtained when the signal a=+0.999.

FIGS. 6A, 6B, and 6C show phase shift amount vs. frequency characteristics of the output signal Y from the phase interpolating filter 15 relative to the input signal X, which have been calculated by frequency expansion of the formula (1), provided that the value of the signal a is set to −0.999, 0.000, and 0.999, respectively. As the value of the signal a progressively varies from −1 to 1, the phase shift amount vs. frequency characteristic continuously changes from FIG. 6A to FIG. 6C via FIG. 6B.

As shown in FIG. 6A, the phase shift amount versus frequency characteristic for a equal to −0.999 is effective only in a frequency range which is above the audio frequency range (i.e., above 20,000 Hz). Referring to FIG. 6B, as the value of a increases toward 0.000, the phase shift amount versus frequency characteristic continually changes, until for a equal to 0.000, the phase shift amount varies approximately linearly (as a function of frequency) from below the audio frequency range (shown as 0 Hz) to above the audio frequency range (shown as 25,000 Hz). Finally, with respect to FIG. 6C, for a equal to 0.999, the phase shift amount is a constant (180° phase shift) over the entire audio frequency range.

Next, the operation of the second embodiment will be explained on the assumption that it is connected to an electronic musical instrument.

Similarly to the first embodiment described hereinbefore, the listener sets the image of musical tones from the electronic musical instrument to a desired location by operating the direction control dial 9*a* and distance control slider 9*b* of the image location operating unit 9. Since as described above, this embodiment is distinguished from the first embodiment only in that the phase interpolating filter is employed as the phase inverting circuit and the signal a is used to control the phase shift amount by the filter, which signal has a value thereof continuously variable from −1 to 1. Therefore, only the control operation in relation to the signal a will be explained below.

Figure 7:
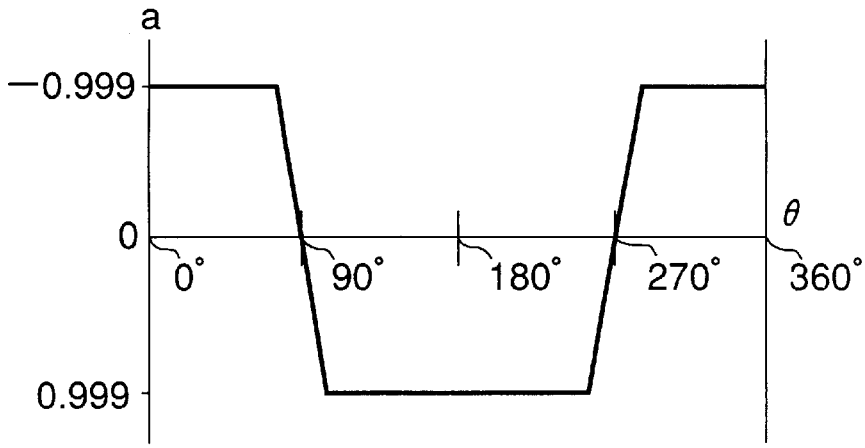
FIG. 7 is a diagram showing a filter coefficient value vs. angle signal θ characteristic of the phase interpolating filter in FIG. 5.

As the direction control dial 9*a* is rotated, the value of the angle signal θ from the image location operating unit 9 varies. The control parameter generator 10 determines the value of the signal a based upon the value of the angle signal θ. The signal a value is determined relative to the angle signal θ value as shown in FIG. 7. More specifically, in the figure, as the set location of the image progressively moves from a forward position to a rearward position with respect to the listener, the signal a value continuously varies from −0.999 to 0.999 (in the vicinity of θ=90°), whereas as the set image location progressively moves from a rearward position to a forward position with respect to the listener, the signal a value continuously varies from 0.999 to −0.999 (in the vicinity of θ=270°).

Therefore, since as mentioned before, the phase shift amount vs. frequency characteristic of the phase interpolating filter 15 continuously varies, the localization of a sound image of sound from the musical instrument smoothly changes as the image is moved from a forward position toward a rearward position, and further a sudden inversion in the phase is avoided to thereby prevent occurrence of a discontinuity noise.

In the present embodiment, the other signals than the signal a, i.e. the signals Tl, Tr, Cl, Cr are controlled in manners similar to the first embodiment described hereinbefore, and description thereof is therefore omitted.

According to the second embodiment described above, it is possible to clearly discriminate between an image-localized position forward of the listener and one rearward of the listener, as in the first embodiment. In addition, the changeover between a forward image-localized position and a rearward image-localized position is smoothly carried out.

Filters other than the phase interpolating filter 15 may be employed in the invention insofar as they are able to shift the phase of an input signal into a nearly inverted phase. Particularly, the use of a filter which has a flat or constant amplitude characteristic is desirable to minimize its influence upon the tone quality.

Figure 8:
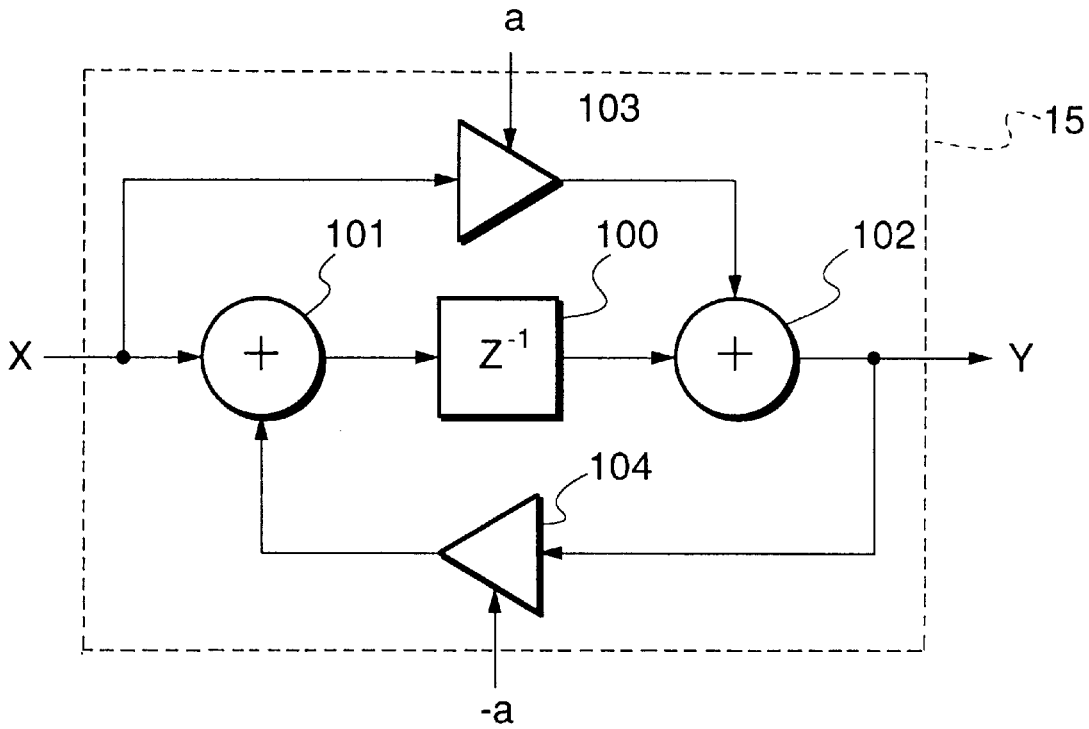
FIG. 8 is a schematic block diagram showing the arrangement of another example of the phase interpolating filter.

Further, a phase interpolating filter having a construction shown in FIG. 8 may be employed in place of the filter 15 having the construction shown in FIG. 5. The filter of FIG. 8 is formed by one delay element 100, two adders 101 and 102, and two multipliers 103 and 104 and is therefore simpler in construction.

It is also known to control localization of a sound image in the vertical directions by the use of a notch filter in an audio playback apparatus or a like acoustic apparatus.

Figure 9:
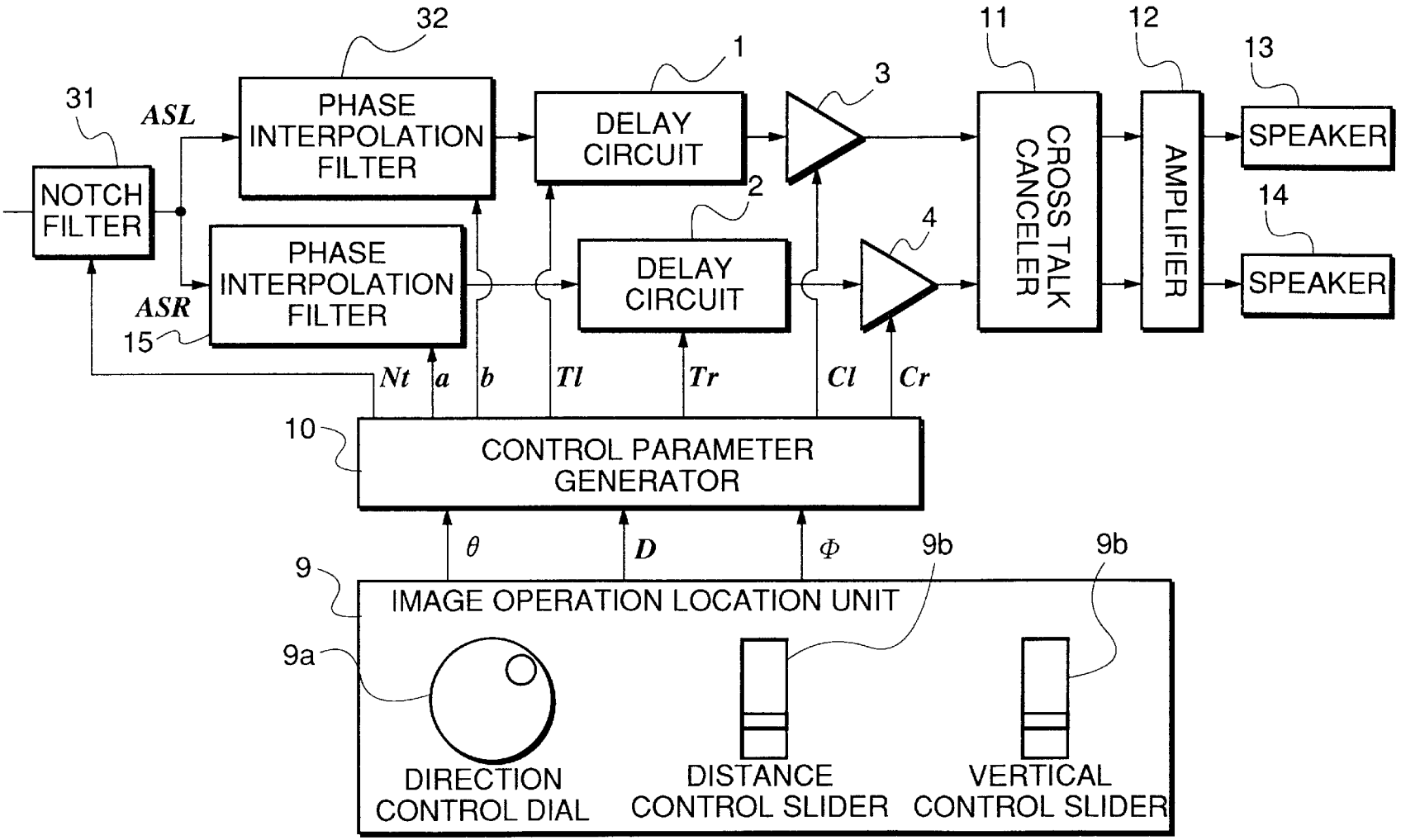
FIG. 9 is a schematic block diagram showing the arrangement of a third embodiment of the invention.

FIG. 9 shows the arrangement of a third embodiment of the invention. In this embodiment, a notch filter is employed in order to control localization of a sound image in the vertical directions so that a feeling of three-dimensional sound image localization can be obtained in cooperation with the localization of the image depending upon the direction and distance described in the preceding embodiments. Moreover, this embodiment can further reduce noise and unsmoothness occurring upon inversion of the phase as compared with the second embodiment described above. That is, in the first and second embodiments, an invertor 7 or a phase interpolating filter 15 is provided only in the right audio signal channel. As a result, when the amplitude (volume) of the audio signal is large, large noise is generated upon sudden inversion of the phase of the audio signal in the arrangement of the first embodiment using the invertor, whereas in the second embodiment using the phase interpolating filter, the listener may have a feeling of unsmoothness upon sudden inversion of the phase.

The third embodiment has overcome these disadvantages in the first and second embodiments.

The third embodiment is distinguished from the second embodiment described above only in that a notch filter is employed and a phase interpolating filter is also provided in the left audio signal channel. Therefore, elements and parts corresponding to those in FIG. 4 are designated by identical reference numerals, and detailed description thereof is omitted.

In the arrangement of FIG. 9, a notch filter 31 is arranged at an input side of the sound image localization device, and phase interpolating filters 32 and 15 are connected to inputs of respective delay circuits 1, 2. A digital audio signal passing through the notch filter 31 supplied as signals ASL, ASR. The left channel signal ASL is supplied to the phase interpolating filter 32, and the right channel signal ASR to the phase interpolating filter 15, similarly to the arrangement of FIG. 4. The notch filter 31 is supplied with a signal Nt for controlling a filter coefficient thereof such that the filter can attenuate signal components of a specific frequency range thereof, and the phase interpolating filter 32 with a signal b for controlling a filter coefficient thereof so as to vary the phase of an input signal thereto, like the phase interpolating filter 15.

The image location operating unit 9 additionally includes a vertical control slider 9*c* as compared with the image location operating unit 9 of the second embodiment in FIG. 4. The operating unit 9 is adapted to generate an elevation angle signal which indicates a value of angle of elevation Φ variable from −90° (right beneath the listener's head)) to +90° (right over the listener's head) depending upon an amount of vertical movement of the vertical control slider 9*c*. The elevation angle signal Φ is supplied to the control parameter generator 10, which in turn calculates the value of the signal Nt in response to the input elevation angle signal Φ and supplies the calculated signal Nt to the notch filter 31. Further, the control parameter generator 10 operates in response to the angle signal θ from the image location operating unit 9 to calculate and supply signals a, b having characteristics shown in FIGS. 10A and 10B to the respective phase interpolating filters 15, 32.

Figure 10A:
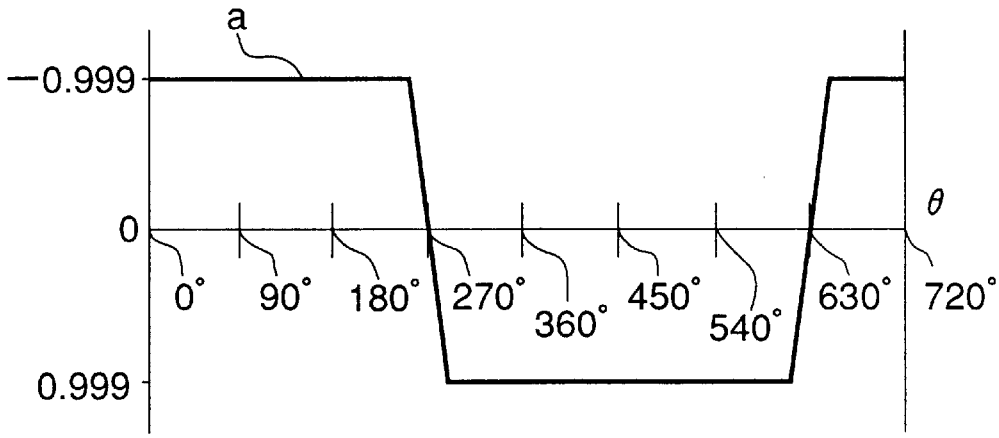
FIG. 10A is a diagram showing a filter coefficient value vs. angle signal θ characteristic of a phase interpolating filter of a right channel audio signal in FIG. 9.
Figure 10B:
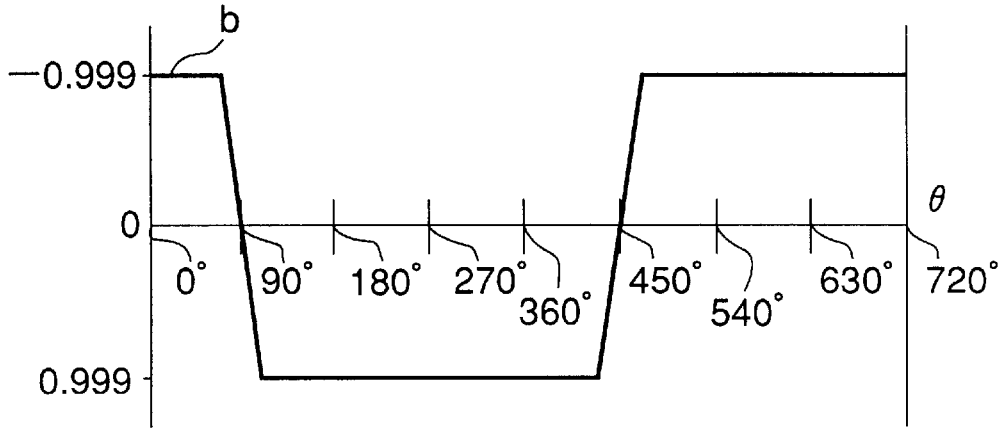
FIG. 10B is a similar view to FIG. 10A, showing the characteristic of a phase interpolating filter of a left channel audio signal in FIG. 9.

FIGS. 10A and 10B show angle filter coefficient value vs. signal θ characteristics of the respective phase interpolating filters 15, 32, which are similar to the characteristic of FIG. 7. According to the illustrated characteristics, the phases of the signals a and b change from −0.999 and return to the same value as the angle θ changes from 0° and over 720° (two rotations), while always maintaining the phase difference between the signals a, b at 180°.

The operation of the present embodiment will be described hereinbelow.

When the listener rotates the direction control dial 9*a* to set the angle of the image or imaginary sound source S to 90°, only the audio signal inputted to the phase interpolating filter 32 is inverted in phase, so that the listener feels that the image has moved into a rearward position. On this occasion, the image has moved from the first quadrant to the second quadrant in the coordinates of FIG. 2, where the left channel audio signal is smaller in amplitude than the right channel audio signal to the listener, due to a difference in the distance relative to the imaginary sound source between the listener's ears. That is, the phase of the audio signal having smaller amplitude has been inverted.

Then, when the angle θ of the imaginary sound source has reached 270°, the right channel audio signal inputted to the phase interpolating filter 15 is inverted in phase, so that the listener now feels that the image has moved into a forward position. Also on this occasion, the phase of the audio signal having smaller amplitude has been inverted. Similarly, when the angle θ of the imaginary sound source S has reached 450° and 630°, the phase of the audio signal having smaller amplitude is inverted. In this way, the image-localized position can be moved from a forward position to a rearward position or vice versa.

According to this embodiment, as described above, in controlling the image-localized position in the horizontal directions from a forward position to a rearward position or vice versa, the one having smaller amplitude of the left and right channel signals is inverted in phase. As a result, the sound image can be smoothly moved between a forward position and a rearward position, thus making it possible to reduce inversion noise and unsmoothness in changing the image-localized position.

Further, according to the third embodiment, as described above, by vertically operating the vertical control slider 9*c* to control the signal Nt applied to the notch filter 31, the localization of the image can also be controlled in the vertical directions.

While preferred embodiments of the invention have been described, variations thereto will occur to those skilled in the art within the scope of the present inventive concepts which are delineated by the following claims.

What is claimed is:

1. A sound image localization device comprising:

a sound source;

first channel signal generation means including first delay and amplitude controls for generating a first channel signal on a basis of said sound source;

second channel signal generation means including second delay and amplitude controls for generating a second channel signal on a basis of said sound source, said first and second channel signal generation means causing a time difference and an amplitude difference between said first and second channel signals; and phase shifting means coupled to the second channel generation means for introducing a phase shift to said second channel signal, said phase shifting means having a phase shift versus frequency characteristic which is continuously varied in response to a phase shift control signal to progressively move a location of a sound image, produced by the first and second channel signals, from a forward position to a rearward position without discontinuities in the phase shift.

2. A sound image localization device as claimed in claim 1, wherein said phase shifting means comprises a phase interpolation filter.

3. A sound image localization device as claimed in claim 1, further comprising second phase shifting means for introducing a phase shift to said first channel signal.

4. A sound image localization device as claimed in claim 3, wherein said second phase shifting means comprises a phase interpolation filter.

5. A sound image localization device as claimed in claim 1, further comprising sound image location setting means for setting a sound image localization position of a sound signal from the sound source and outputting control signals corresponding to a sound image localization position set by said sound image location setting means, wherein said control signals include a time delay control signal, an amplitude control signal and the phase shift control signal, and wherein said first and second channel signal generation means are responsive to the time delay and amplitude control signals to cause the time difference and the amplitude difference between said first and second channels signals to vary, and further wherein the phase shifting means is responsive to the phase shift control signal to cause a variable phase versus frequency difference between said first and second channel signals.

6. A sound image localization device as claimed in claim 1, wherein said first and second channel generation means comprise a delay device and a multiplier.

7. A sound image localization device, the sound image localization device receiving a sound signal from a sound source, the sound image localization device comprising:

a first channel signal generation device including first delay and amplitude controls for generating a first channel signal on a basis of the sound signal of said sound source;

a second channel signal generation device including second delay and amplitude controls for generating a second channel signal on a basis of the sound signal of said sound source, said first and second channel signal generation devices causing a time difference and an amplitude difference between said first and second channel signals; and a phase shifting device coupled to the second channel generation device for introducing a phase shift to said second channel signal, said phase shifting device having a phase shift versus frequency characteristic which is continuously varied in response to a phase shift control signal to progressively move a location of a sound image, produced by the first and second channel signals, from a forward position to a rearward position without discontinuities in the phase shift.

8. A sound image localization device as claimed in claim 7, wherein said first and second channel generation devices comprise a delay device and a multiplier.

9. A sound image localization device as claimed in claim 7, wherein said phase shifting device comprises a phase interpolation filter.

10. A sound image localization device connecting a sound source, comprising:

sound image location setting means for setting on a real time basis a sound image localization position of a sound signal from the sound source;

first and second channel signal generation means for generating first and second channel signals on a basis of said sound source, said first and second channel signal generation means causing a time difference and an amplitude difference between said first and second channel signals in accordance with a sound image localization position set by said sound image localization setting means; and phase shifting means for introducing a phase shift to each of said first and second channel signals in accordance with a sound image localization position set by said sound image location setting means and having a phase shift versus frequency characteristic which is continuously varied to progressively move a location of a sound image, produced by the first and second channel signals, from a forward position to a rearward position without discontinuities in the phase shift.

11. A sound image localization device as claimed in claim 10, wherein said phase shifting means comprise a pair of phase interpolation filters, one for each of the first and second channel signals.

12. A sound image localization device as claimed in claim 10, wherein said first and second channel signal generation means each comprise a delay device and a multiplier.

13. A sound image localization device as claimed in claim 10, further comprising a pair of loudspeakers for respectively generating the first and second channel signals, and a cross-talk canceling device provided between said first and second channel signal generating means and the pair of loudspeakers for canceling cross-talk between the pair of loudspeakers and a listener.

14. A sound image localization device as claimed in claim 10, further comprising a notch filter coupled between said sound source and at least one of the first and second channel signal generation means for controlling the sound image localization position in vertical directions.

15. A sound image localization device comprising:

a sound source;

first channel signal generation means for generating a first channel signal on a basis of said sound source;

second channel signal generation means for generating a second channel signal on a basis of said sound source, said first and second channel signal generation means causing a time difference and an amplitude difference between said first and second channel signals; and phase shifting means for introducing a phase shift to said second channel signal, said phase shifting means having a phase shift verses frequency characteristic which is continuously varied in response to a phase shift control signal, wherein said phase shifting means comprises a phase interpolation filter, including:

a first delay circuit having an input and an output, the input of the first delay circuit being coupled to the second channel generation means for receiving the second channel signal;

a first summing circuit having first and second inputs and an output, the first input of the first summing circuit being coupled to the output of the first delay circuit;

a second delay circuit having an input and an output, the input of the second delay circuit being coupled to the output of the first summing circuit;

a second summing circuit having first and second inputs and an output, the first input of the second summing circuit being coupled to the output of the second delay circuit;

a multiplier circuit having first and second inputs and an output, the first input of the multiplier circuit being coupled to the phase shift control signal, the second input of the multiplier circuit being coupled to the output of the second summing circuit, and the output of the multiplier circuit being coupled to the second input of the first summing circuit; and an inverter circuit having an input and an output, the input of the inverter circuit being coupled to the sound source and the output of the inverter circuit being coupled to the second input of the second summing circuit, wherein the output of the first summing circuit is provided as the output of the phase interpolation filter.

16. A sound image localization device comprising:

a sound source;

first channel signal generation means for generating a first channel signal on a basis of said sound source;

second channel signal generation means for generating a second channel signal on a basis of said sound source, said first and second channel signal generation means causing a time difference and an amplitude difference between said first and second channel signals;

phase shifting means for introducing a phase shift to said second channel signal, said phase shifting means having a phase shift verses frequency characteristic which is continuously varied in response to a phase shift control signal, wherein said phase shifting means comprises a phase interpolation filter; and means for producing an inverted phase shift control signal from the phase shift control signal, and wherein the phase interpolation filter comprises:

a first summing circuit having first and second inputs and an output, the first input of the first summing circuit being coupled to the second channel generation means for receiving the second channel signal;

a delay circuit having an input and an output, the input of the delay circuit being coupled to the output of the first summing circuit;

a first multiplier circuit having first and second inputs and an output, the first input of the first multiplier circuit being coupled to the second channel generation means for receiving the second channel signal and the second input of the first multiplier circuit being coupled to the phase shift control signal;

a second summing circuit having first and second inputs and an output, the first input of the second summing circuit being coupled to the output of the delay circuit, and the second input of the second summing circuit being coupled to the output of the first multiplier circuit; and a second multiplier circuit having first and second inputs and an output, the first input of the second multiplier circuit being coupled to the output of the second summing circuit, the second input of the second multiplier circuit being coupled to the inverted phase shift control signal, and the output of the second multiplier circuit being coupled to the second input of the first summing circuit, wherein the output of the first summing circuit is provided as the output of the phase interpolation circuit.

17. A sound image localization device, the sound image localization device receiving a sound signal from a sound source, the sound image localization device comprising:

a first channel signal generation device for generating a first channel signal on a basis of the sound signal of said sound source;

a second channel signal generation device for generating a second channel signal on a basis of the sound signal of said sound source, said first and second channel signal generation devices causing a time difference and an amplitude difference between said first and second channel signals; and a phase shifting device for introducing a phase shift to said second channel signal, said phase shifting device having a phase shift versus frequency characteristic which is continuously varied in response to a phase shift control signal, wherein said phase shifting device comprises a phase interpolation filter, including:

a first delay circuit having an input and an output, the input of the first delay circuit being coupled to the second channel signal;

a first summing circuit having first and second inputs and an output, the first input of the first summing circuit being coupled to the output of the first delay circuit;

a second delay circuit having an input and an output, the input of the second delay circuit being coupled to the output the first summing circuit;

a second summing circuit having first and second inputs and an output, the first input of the second summing circuit being coupled to the output of the second delay circuit;

a multiplier circuit having first and second inputs and an output, the first input of the multiplier circuit being coupled to the phase shift control signal, the second input of the multiplier circuit being coupled to the output of the second summing circuit, and the output of the multiplier circuit being coupled to the second input of the first summing circuit; and an inverter circuit having an input and an output, the input of the inverter circuit being coupled to the sound signal and the output of the inverter circuit being coupled to the second input of the second summing circuit, wherein the output of the first summing circuit is provided as the output of the phase interpolation filter.

18. A sound image localization device, the sound image localization device receiving a sound signal from a sound source, the sound image localization device comprising:

a first channel signal generation device for generating a first channel signal on a basis of the sound signal of said sound source;

a second channel signal generation device for generating a second channel signal on a basis of the sound signal of said sound source, said first and second channel signal generation devices causing a time difference and an amplitude difference between said first and second channel signals;

a phase shifting device for introducing a phase shift to said second channel signal, said phase shifting device having a phase shift versus frequency characteristic which is continuously varied in response to a phase shift control signal, wherein said phase shifting device comprises a phase interpolation filter; and means for producing an inverted phase shift control signal from the phase shift control signal, and wherein the phase interpolation filter comprises:

a first summing circuit having first and second inputs and an output, the first input of the first summing circuit being coupled to the second channel signal;

a delay circuit having an input and an output, the input of the delay circuit being coupled to the output of the first summing circuit;

a first multiplier circuit having first and second inputs and an output, the first input of the first multiplier circuit being coupled to the second channel signal and the second input of the first multiplier circuit being coupled to the phase shift control signal;

a second summing circuit having first and second inputs and an output, the first input of the second summing circuit being coupled to the output of the delay circuit, and the second input of the second summing circuit being coupled to the output of the first multiplier circuit; and a second multiplier circuit having first and second inputs and an output, the first input of the second multiplier circuit being coupled to the output of the second summing circuit, the second input of the second multiplier circuit being coupled to the inverted shift control signal, and the output of the second multiplier circuit being coupled to the second input of the first summing circuit, wherein the output of the first summing circuit is provided as the output of the phase interpolation circuit.

19. A sound image localization device connecting a sound source, comprising:

sound image location setting means for setting on a real time basis a sound image localization position of a sound signal from the sound source;

first and second channel signal generation means for generating first and second channel signals on a basis of said sound source, said first and second channel signal generation means causing a time difference and an amplitude difference between said first and second channel signals in accordance with a sound image localization position set by said sound image localization setting means; and phase shifting means for introducing a phase shift to each of said first and second channel signals in accordance with a sound image localization position set by said sound image location setting means and having a phase shift versus frequency characteristic which is continuously varied, wherein said phase shifting means comprise a pair of phase interpolation filters, one for each of the first and second channel signals, wherein at least one of the phase interpolation filters comprises:

a first delay circuit having an input and an output, the input of the first delay circuit being coupled to one of the first and second channel signals;

a first summing circuit having first and second inputs and an output, the first input of the first summing circuit being coupled to the output of the first delay circuit;

a second delay circuit having an input and an output, the input of the second delay circuit being coupled to the output of the first summing circuit;

a second summing circuit having first and second inputs and an output, the first input of the second summing circuit being coupled to the output of the second delay circuit;

a multiplier circuit having first and second inputs and an output, the first input of the multiplier circuit being coupled to the phase shift control signal, the second input of the multiplier circuit being coupled to the output of the second summing circuit, and the output of the multiplier circuit being coupled to the second input of the first summing circuit; and an inverter circuit having an input and an output, the input of the inverter circuit being coupled to the sound signal and the output of the inverter circuit being coupled to the second input of the second summing circuit, wherein the output of the first summing circuit is provided as the output of the phase interpolation filter.

20. A sound image localization device connecting a sound source, comprising:

sound image location setting means for setting on a real time basis a sound image localization position of a sound signal from the sound source;

first and second channel signal generation means for generating first and second channel signals on a basis of said sound source, said first and second channel signal generation means causing a time difference and an amplitude difference between said first and second channel signals in accordance with a sound image localization position set by said sound image localization setting means; and phase shifting means for introducing a phase shift to each of said first and second channel signals in accordance with a sound image localization position set by said sound image location setting means and having a phase shift versus frequency characteristic which is continuously varied, wherein said phase shifting means comprise a pair of phase interpolation filters, one for each of the first and second channel signals; and means for producing an inverted phase shift control signal from the phase shift control signal, and wherein at least one of the phase interpolation filters comprises:

a first summing circuit having first and second inputs and an output, the first input of the first summing circuit being coupled to one of the first and second channel signals;

a delay circuit having an input and an output, the input of the delay circuit being coupled to the output of the first summing circuit;

a first multiplier circuit having first and second inputs and an output, the first input of the first multiplier circuit being coupled to the one of the first and second channel signals and the second input of the first multiplier circuit being coupled to the phase shift control signal;

a second summing circuit having first and second inputs and an output, the first input of the second summing circuit being coupled to the output of the delay circuit, and the second input of the second summing circuit being coupled to the output of the first multiplier circuit; and a second multiplier circuit having first and second inputs and an output, the first input of the second multiplier circuit being coupled to the output of the second summing circuit, the second input of the second multiplier circuit being coupled to the inverted phase shift control signal, and the output of the second multiplier circuit being coupled to the second input of the first summing circuit, wherein the output of the first summing circuit is provided as the output of the phase interpolation circuit.

21. A sound image localization device, the sound image localization device adapted for receiving a sound signal from a sound source, the sound image localization device comprising:

a first channel signal generation device including first delay and amplitude controls for generating a first channel signal on a basis of the sound signal of the sound source;

a second channel signal generation device including second delay and amplitude controls for generating a second channel signal on a basis of the sound signal of the sound source, the first and second channel signal generation devices causing a time difference and an amplitude difference between the first and second channel signals; and a phase shifting device coupled to the second channel generation device for introducing a phase shift to the second channel signal, the phase shifting device having a phase shift versus frequency characteristic which is varied in response to a phase shift control signal, wherein the phase shift versus frequency characteristic is a constant for a first value of the phase shift control signal, and wherein the phase shift versus frequency characteristic changes linearly as a function of frequency for a second value of the phase shift control signal.

22. A sound image localization device as claimed in claim 21, wherein phase shift versus frequency characteristic constant is substantially 180° when the first value of the phase shift control signal substantially equals 0.999, wherein the phase shift versus frequency characteristic varies linearly from 0° for a frequency of 0 Hz to substantially 180° for a first frequency above the audio range when the phase shift control signal substantially equals 0.000, and wherein the phase shift versus frequency characteristic varies for a third value of the phase shift control signal so that the phase shift versus frequency characteristic varies linearly from 0° for a second frequency above the audio range to substantially 180° for a third frequency above the audio range when the phase control signal is substantially equal to −0.999.

23. A sound image localization device as claimed in claim 21, wherein the phase shift versus frequency characteristic varies continuously from the constant to the linear change from a predetermined frequency as the phase shift control signal is varied continuously from the first value to the second value of the phase shift control signal.

24. A sound image localization device as claimed in claim 21, wherein the first and second channel generation devices each comprise a delay device and a multiplier.

25. A sound image localization device as claimed in claim 21, wherein the phase shifting device comprises a phase interpolation filter.

26. A sound image localization device as claimed in claim 21, further comprising a second phase shifting device that introduces a phase shift to the first channel signal.

27. A sound image localization device as claimed in claim 26, wherein the second phase shifting device comprises a phase interpolation filter.

28. A sound image localization device as claimed in claim 21, further comprising a sound image location setting circuit that sets a sound image localization position of a sound signal from the sound source and outputs control signals corresponding to a sound image localization position set by the sound image location setting circuit, wherein the control signals include a time delay control signal, an amplitude control signal and the phase shift control signal, and wherein the first and second channel signal generation devices are responsive to the time delay and amplitude control signals to cause the time difference and the amplitude difference between the first and second channels signals to vary, and further wherein the phase shifting device is responsive to the phase shift control signal to cause a variable phase versus frequency difference between the first and second channel signals.

29. A sound image localization device as claimed in claim 28, further comprising a pair of loudspeakers for respectively generating the first and second channel signals, and a cross-talk canceling device provided between the first and second channel signal generating devices and the pair of loudspeakers for canceling cross-talk between the pair of loudspeakers and a listener.

30. A sound image localization device, the sound image localization device adapted for receiving a sound signal from a sound source, the sound image localization device comprising:

a first channel signal generation device for generating a first channel signal on a basis of the sound signal of the sound source;

a second channel signal generation device for generating a second channel signal on a basis of the sound signal of the sound source, the first and second channel signal generation devices causing a time difference and an amplitude difference between the first and second channel signals; and a phase shifting device for introducing a phase shift to one of the first and second channel signals, the phase shifting device having a phase shift versus frequency characteristic which is varied in response to a phase shift control signal, wherein the phase shift versus frequency characteristic is defined as $$H(z)=Y/X=-(a-z^{-1})/(1-a*z^{-1})$$

where a is a value of the phase shift control signal, X is one of the first and second channel signals input to the phase shifting device, Y is the phase shifted one of the first and second channel signals output by the phase shifting device, and * denotes multiplication.

31. A sound image localization device as claimed in claim 30, wherein the first and second channel generation devices each comprise a delay device and a multiplier.

32. A sound image localization device as claimed in claim 30, wherein the phase shifting device comprises a phase interpolation filter.

33. A sound image localization device as claimed in claim 30, further comprising second phase shifting device that introduces a phase shift to the other of the first and second channel signals.

34. A sound image localization device as claimed in claim 33, wherein the second phase shifting device comprises a phase interpolation filter.

35. A sound image localization device as claimed in claim 30, further comprising a sound image location setting circuit that sets a sound image localization position of a sound signal from the sound source and outputs control signals corresponding to a sound image localization position set by the sound image location setting circuit, wherein the control signals include a time delay control signal, an amplitude control signal and the phase shift control signal, and wherein the first and second channel signal generation devices are responsive to the time delay and amplitude control signals to cause the time difference and the amplitude difference between the first and second channels signals to vary, and further wherein the phase shifting device is responsive to the phase shift control signal to cause a variable phase versus frequency difference between the first and second channel signals.

36. A sound image localization device as claimed in claim 35, further comprising a pair of loudspeakers for respectively generating the first and second channel signals, and a cross-talk canceling device provided between the first and second channel signal generating devices and the pair of loudspeakers for canceling cross-talk between the pair of loudspeakers and a listener.

* * * * *